US012773012B2

(12) United States Patent
Jordil et al.

(10) Patent No.: US 12,773,012 B2
(45) Date of Patent: Oct. 27, 2026

(54) AEROSOL-GENERATING SYSTEM HAVING A VENTILATION CHAMBER

(71) Applicant: Philip Morris Products S.A., Neuchatel (CH)

(72) Inventors: Yves Jordil, Neuchatel (CH); Mirko Minzoni, Neuchatel (CH)

(73) Assignee: Philip Morris Products S.A., Neuchatel (CH)

( * ) Notice: Subject to any disclaimer, the term of this patent is extended or adjusted under 35 U.S.C. 154(b) by 539 days.

(21) Appl. No.: 17/787,816

(22) PCT Filed: Dec. 21, 2020

(86) PCT No.: PCT/EP2020/087532
§ 371 (c)(1),
(2) Date: Jun. 21, 2022

(87) PCT Pub. No.: WO2021/130191
PCT Pub. Date: Jul. 1, 2021

(65) Prior Publication Data

US 2023/0337747 A1 Oct. 26, 2023

(30) Foreign Application Priority Data

Dec. 23, 2019 (EP) ..... 19219534

(51) Int. Cl.
*A24F 40/48* (2020.01)
*A24D 1/02* (2006.01)
(Continued)

(52) U.S. Cl.
CPC ..... *A24F 40/48* (2020.01); *A24D 1/027* (2013.01); *A24D 1/045* (2013.01); *A24D 1/20* (2020.01);
(Continued)

(58) Field of Classification Search
CPC ..... A24F 40/48; A24F 40/20; A24D 1/027; A24D 1/045; A24D 1/20; A24D 3/17
See application file for complete search history.

(56) References Cited

U.S. PATENT DOCUMENTS 5,666,978 A 9/1997 Counts et al.
5,878,752 A 3/1999 Adams et al.
(Continued)

FOREIGN PATENT DOCUMENTS

CN 104135881 A 11/2014
CN 107205494 A 9/2017
(Continued)

OTHER PUBLICATIONS

International Search Report issued Apr. 12, 2021 in PCT/EP2020/087532 filed on Dec. 21, 2020, 4 pages.
(Continued)

*Primary Examiner* — Michael H. Wilson
*Assistant Examiner* — Jennifer A Kessie
(74) *Attorney, Agent, or Firm* — Oblon, McClelland, Maier & Neustadt, L.L.P.

(57) ABSTRACT

An aerosol-generating system is provided, including: an aerosol-generating article including a rod of aerosol-forming substrate, a filter downstream of the rod, the rod and the filter being assembled within a wrapper, and a ventilation zone located on the wrapper and including apertures extending through the wrapper; and an aerosol-generating device including distal and mouth ends, a housing including a peripheral wall defining a device cavity to removably receive the article at the mouth end, and a heater to heat the substrate when the article is received within the device cavity, such that, when the article is received within the device cavity, the ventilation zone is located within the device cavity and a portion of an internal surface of the
(Continued)

peripheral wall overlying the zone is spaced apart from the article to define a ventilation chamber within the peripheral wall.

16 Claims, 2 Drawing Sheets

(51) Int. Cl.

| | |
|---|---|
| ***A24D 1/04*** | (2006.01) |
| ***A24D 1/20*** | (2020.01) |
| ***A24D 3/17*** | (2020.01) |
| ***A24F 40/20*** | (2020.01) |
| ***A24F 40/46*** | (2020.01) |

(52) U.S. Cl.
CPC ..... *A24D 3/17* (2020.01); *A24F 40/20* (2020.01); *A24F 40/46* (2020.01)

(56) References Cited

U.S. PATENT DOCUMENTS

| | | | | |
|---|---|---|---|---|
| 5,934,289 | A | 8/1999 | Watkins et al. | |
| 2003/0154991 | A1 | 8/2003 | Fournier et al. | |
| 2004/0089314 | A1 | 5/2004 | Felter et al. | |
| 2004/0200488 | A1 | 10/2004 | Felter et al. | |
| 2013/0139836 | A1* | 6/2013 | Blick | A24D 3/043 131/365 |
| 2018/0049472 | A1* | 2/2018 | Mahler | A24F 40/46 |
| 2020/0345075 | A1* | 11/2020 | Hepworth | A24F 40/46 |

FOREIGN PATENT DOCUMENTS

| | | | |
|---|---|---|---|
| DE | 198 54 005 | C2 | 5/2001 |
| EP | 3 076 815 | | 10/2016 |
| EP | 2 961 288 | B1 | 10/2018 |
| EP | 3 610 741 | A1 | 2/2020 |
| JP | 2002-514910 | A | 5/2002 |
| JP | 2005-517421 | A | 6/2005 |
| JP | 2015-504667 | A | 2/2015 |
| JP | 2016-538848 | A | 12/2016 |
| JP | 2018-504134 | A | 2/2018 |
| JP | 2019-523639 | A | 8/2019 |
| JP | 2019-528734 | A | 10/2019 |
| JP | 2021-526028 | A | 9/2021 |
| KR | 10-2004-0084899 | A | 10/2004 |
| KR | 10-2017-0115492 | A | 10/2017 |
| KR | 10-2018-0095080 | A | 8/2018 |
| RU | 2 602 053 | C2 | 11/2016 |
| RU | 184 342 | U1 | 10/2018 |
| RU | 2 709 939 | C1 | 12/2019 |
| WO | WO 99/20939 | A1 | 4/1999 |
| WO | WO 2012/164009 | A2 | 12/2012 |
| WO | WO 2013/076098 | A2 | 5/2013 |
| WO | WO 2015/052652 | A1 | 4/2015 |
| WO | WO 2015/082649 | A1 | 6/2015 |
| WO | WO 2016/124550 | A1 | 8/2016 |
| WO | WO 2017/194751 | A1 | 11/2017 |
| WO | WO 2017/194762 | A1 | 11/2017 |
| WO | WO 2017/194763 | A2 | 11/2017 |
| WO | WO 2017/198838 | A1 | 11/2017 |
| WO | WO 2018/190606 | A1 | 10/2018 |
| WO | WO 2019/012145 | A1 | 1/2019 |
| WO | WO 2019/033233 | A1 | 2/2019 |
| WO | WO 2019/096983 | A1 | 5/2019 |
| WO | WO 2020/128043 | A1 | 6/2020 |
| WO | WO 2020/193240 | A1 | 10/2020 |
| WO | WO 2021/089413 | A1 | 5/2021 |
| WO | WO 2021/089414 | A1 | 5/2021 |
| WO | WO 2021/089543 | A1 | 5/2021 |

OTHER PUBLICATIONS

Written Opinion issued Apr. 12, 2021 in PCT/EP2020/087532 filed on Dec. 21, 2020, 6 pages.
Russian Notice of Allowance and Search Report (with English translation) issued Jan. 26, 2024 in corresponding Russian Patent Application No. 2022119862, 20 pages.
European Office Action issued Jun. 28, 2023 in European Patent Application No. 20833895.4, 6 pages.
Combined Chinese Office Action and Search Report issued Nov. 9, 2024 in Chinese Patent Application No. 202080089321.7 (with English Translation), 20 pages.
Japanese Office Action issued Dec. 19, 2024 in Japanese Patent Application No. 2022-537440 (with English Translation), 10 pages.
Eaton et al., "Assessment of tobacco heating product THP1.0. Part 2: Product design, operation and thermophysical characterisation", Regulatory Toxicology and Pharmacology, 2018, vol. 93, pp. 4-13.
Davis et al., "Tobacco: Production, Chemistry and Technology", Blackwell Publishing Ltd., 1999, 20 pages.
Office Action dated Nov. 21, 2025, issued in corresponding South Korean Patent Application No. 2022-7025065 (with English translation).
Japanese Office Action issued Feb. 9, 2026, in corresponding Japanese Patent Application No. 2025-075578 (with English Translation), 8 pages.

* cited by examiner

AEROSOL-GENERATING SYSTEM HAVING A VENTILATION CHAMBER

The present invention relates to an aerosol-generating system comprising an aerosol-generating device configured to receive an aerosol-generating article. The present application also relates to an aerosol-generating device having a ventilation chamber.

Aerosol-generating articles in which an aerosol-forming substrate, such as a tobacco-containing substrate, is heated rather than combusted, are known in the art. Typically in such heated smoking articles, an aerosol is generated by the transfer of heat from a heat source to a physically separate aerosol-forming substrate or material, which may be located in contact with, within, around, or downstream of the heat source. During use of the aerosol-generating article, volatile compounds are released from the aerosol-forming substrate by heat transfer from the heat source and are entrained in air drawn through the aerosol-generating article. As the released compounds cool, they condense to form an aerosol.

A number of prior art documents disclose aerosol-generating devices for consuming aerosol-generating articles. Such devices include, for example, electrically heated aerosol-generating devices in which an aerosol is generated by the transfer of heat from one or more electrical heater elements of the aerosol-generating device to the aerosol-forming substrate of a heated aerosol-generating article.

However, when an aerosol-generating article having ventilating apertures (referred to as a 'ventilation zone') on its outer wrapper is received within known aerosol-generating devices, such ventilating apertures can be exposed to the external environment of the device. During use of the article within the device, the ventilating apertures may provide beneficial dilution of the aerosol flowing through the article to be delivered to the consumer, as well as ventilating airflow that can reduce the temperature of the generated aerosol.

The exposure of the ventilating apertures may result in a consumer inadvertently blocking the ventilating apertures of the article with his fingers or lips during normal use of the aerosol-generating system. In turn, such blockage may affect the consumer's sensorial experience by increasing the effective resistance-to-draw of the article and hindering optimal aerosol formation and cooling. Therefore, it would be desirable to provide an aerosol-generating system that addresses at least this issue.

In the present specification, there is provided an aerosol-generating device configured to receive an aerosol-generating article. The aerosol-generating article may comprise a rod of aerosol-forming substrate. The aerosol-generating article may comprise a filter assembled in a wrapper. The aerosol-generating article may further comprise a ventilation zone located on the wrapper. The ventilation zone may comprise a plurality of apertures extending through the wrapper. The aerosol-generating device may have a distal end and a mouth end. The aerosol-generating device may comprise a housing. The housing may comprise a peripheral wall defining a device cavity for removably receiving the aerosol-generating article at the mouth end of the device. The aerosol-generating device may comprise a heater for heating the aerosol-forming substrate when the aerosol-generating article is received within the device cavity. The aerosol-generating device may be configured so that, when an aerosol-generating article is received within the device cavity, the ventilation zone of the aerosol-generating article is located within the device cavity and a portion of an internal surface of the peripheral wall overlying the ventilation zone is spaced apart from the aerosol-generating article.

According to the present application, there may be provided an aerosol-generating system that may comprise an aerosol-generating article and an aerosol-generating device. The aerosol-generating article may comprise a rod of aerosol-forming substrate. The aerosol-generating article may comprise a filter positioned downstream of the rod of aerosol-forming substrate. The rod of aerosol-forming substrate and the filter may be assembled within a wrapper. The aerosol-generating article may comprise a ventilation zone located on the wrapper. The ventilation zone may comprise a plurality of apertures extending through the wrapper. The aerosol-generating device may have a distal end and a mouth end. The aerosol-generating device may comprise a housing. The aerosol-generating device may comprise a heater for heating the aerosol-forming substrate when the aerosol-generating article is received within the device cavity. The housing may comprise a peripheral wall. The peripheral wall may define a device cavity for removably receiving the aerosol-generating article at the mouth end of the device. The aerosol-generating system is configured so that, when the aerosol-generating article is received within the device cavity, the ventilation zone of the aerosol-generating article is located within the device cavity and a portion of an internal surface of the peripheral wall overlying the ventilation zone is spaced apart from the aerosol-generating article.

According to the present invention, there is provided an aerosol-generating system comprising an aerosol-generating article and an aerosol-generating device. The aerosol-generating article comprises a rod of aerosol-forming substrate and a filter positioned downstream of the rod of aerosol-forming substrate. The rod of aerosol-forming substrate and the filter are assembled within a wrapper. The aerosol-generating article comprises a ventilation zone located on the wrapper. The ventilation zone comprises a plurality of apertures extending through the wrapper. The aerosol-generating device has a distal end and a mouth end and comprises a housing and a heater for heating the aerosol-forming substrate when the aerosol-generating article is received within the device cavity. The housing comprises a peripheral wall. The peripheral wall defines a device cavity for removably receiving the aerosol-generating article at the mouth end of the device. The aerosol-generating system is configured so that, when the aerosol-generating article is received within the device cavity, the ventilation zone of the aerosol-generating article is located within the device cavity and a portion of an internal surface of the peripheral wall overlying the ventilation zone is spaced apart from the aerosol-generating article.

The aerosol-generating device of the aerosol-generating system may be configured so that, when the aerosol-generating article is received within the device cavity, the ventilation zone of the aerosol-generating article is located within the device cavity and a portion of an internal surface of the peripheral wall overlying the ventilation zone is spaced apart from the aerosol-generating article.

By providing a portion of an internal surface of the peripheral wall overlying the ventilation zone from the aerosol-generating article, it is ensured, during use of the aerosol-generating system, that the ventilation zone of the aerosol-generating article is covered by the housing of the aerosol-generating device and is not exposed to the exterior of the device.

Additionally, by providing such portion of the internal surface of the peripheral wall spaced apart from the ventilation zone of the article, it is also ensured that air or aerosol can flow between the internal surface of the peripheral wall and ventilation zone of the article. This means that the ventilation zone can serve its function of providing ventilation to the article without being obscured or blocked by a consumer.

Such portion of the internal surface of the peripheral wall spaced apart from the ventilation zone of the aerosol-generating article may refer to a portion of the internal surface of the peripheral wall that is further spaced apart from the aerosol-generating article than the rest, or other portions, of the internal surface of the peripheral wall. In other words, such portion of the internal surface of the peripheral wall spaced apart from the ventilation zone of the aerosol-generating article is a portion of the internal surface of the peripheral wall that is further spaced apart from the aerosol-generating article than the rest, or other portions, of the internal surface of the peripheral wall. In other words, such portion of the internal surface of the peripheral wall spaced apart from the ventilation zone of the aerosol-generating article is a portion of the internal surface of the peripheral wall that is further spaced away from the aerosol-generating article than the rest, or other portions, of the internal surface of the peripheral wall.

As used herein, the term "aerosol generating device" refers to a device comprising a heater element that interacts with the aerosol generating substrate of the aerosol generating article to generate an aerosol.

As used herein, the term "longitudinal" refers to the direction corresponding to the main longitudinal axis of the aerosol-generating article or device, which extends between the upstream and downstream ends of the aerosol-generating article or aerosol-generating device.

As used herein, the terms "upstream" and "downstream" describe the relative positions of elements, or portions of elements, of the aerosol-generating article or device in relation to the direction in which the aerosol is transported through the aerosol-generating article during use.

During use, air is drawn through the aerosol-generating article in the longitudinal direction. The term "transverse" refers to the direction that is perpendicular to the longitudinal axis. Any reference to the "cross-section" of the aerosol-generating article or a component of the aerosol-generating article refers to the transverse cross-section unless stated otherwise.

The term "length" denotes the dimension of a component of the aerosol-generating article or device in the longitudinal direction.

As used in the present specification, the term "homogenised tobacco material" encompasses any tobacco material formed by the agglomeration of particles of tobacco material. Sheets or webs of homogenised tobacco material are formed by agglomerating particulate tobacco obtained by grinding or otherwise powdering of one or both of tobacco leaf lamina and tobacco leaf stems. In addition, homogenised tobacco material may comprise a minor quantity of one or more of tobacco dust, tobacco fines, and other particulate tobacco by-products formed during the treating, handling and shipping of tobacco. The sheets of homogenised tobacco material may be produced by casting, extrusion, paper making processes or other any other suitable processes known in the art.

The term "porous" is used herein to refer to a material that provides a plurality of pores or openings that allow the passage of air through the material.

The term "ventilation level" may be used throughout the present specification to denote a volume ratio between of the airflow admitted into the aerosol-generating article via the ventilation zone (ventilation airflow) and the sum of the aerosol airflow and the ventilation airflow. The greater the ventilation level, the higher the dilution of the aerosol flow delivered to the consumer. The ventilation level is measured on the aerosol-generating article on its own—that is, without inserting the aerosol-generating article in a suitable aerosol-generating device adapted to heat the aerosol-forming substrate.

The aerosol-generating article of the present invention comprises a rod of aerosol-forming substrate. The aerosol-generating article may further comprise a downstream section located downstream of the rod of aerosol-forming substrate. Such a downstream section may be regarded as the filter of the aerosol-generating article. The filter (or downstream section of the article), or mouthpiece segment, may comprise a plug of filtration material, and a hollow tubular segment at a location between the rod of aerosol-forming substrate and the mouthpiece segment. All three elements are preferably longitudinally aligned. The rod of aerosol-forming substrate preferably comprises at least an aerosol former. In some embodiments, the aerosol-generating article in accordance with the invention may comprise an additional support element (or support segment) arranged between, and in longitudinal alignment with, the rod of aerosol-forming substrate and the hollow tubular segment. In more detail, the support element (or support segment) is preferably provided immediately downstream of the rod and immediately upstream of the hollow tubular element (or segment). The additional support element or segment may be tubular.

The ventilation zone of the aerosol-generating article may be located at any location along the article. The ventilation zone may be located at a position downstream of the rod of aerosol-forming substrate. The ventilation zone may be located at a position along a hollow tubular segment of the filter or mouthpiece segment of the article. The ventilation zone may be located at a position along the plug of filtration material (or mouthpiece segment) of the filter of the article.

The expression "received within" may refer to the fact that a component or element is fully or partially received within another component or element. For example, the expression "aerosol-generating article is received within the device cavity" refers to the aerosol-generating article being fully or partially received within the device cavity of the aerosol-generating article. When the aerosol-generating article is received within the device cavity, the aerosol-generating article may abut the distal end of the device cavity. When the aerosol-generating article is received within the device cavity, the aerosol-generating article may be in substantial proximity to the distal end of the device cavity. The distal end of the device cavity may be defined by an end-wall.

The length of the device cavity may be between about 10 mm and about 50 mm. The length of the device cavity may be between about 20 mm and about 40 mm. The length of the device cavity may be between about 25 mm and about 30 mm.

The space defined by the portion of an internal surface of the peripheral wall may define a ventilation chamber within the peripheral wall. The ventilation chamber may be configured to be in fluid communication with the exterior of the aerosol-generating device and the ventilation zone of the aerosol-generating article. Preferably, the ventilation chamber is defined within the thickness of the peripheral wall. In other words, the ventilation chamber may be defined on a surface (for example, the interior or inner surface) of the peripheral wall or within the thickness of the peripheral wall, at a position between the inner and outer longitudinal surfaces of the peripheral wall.

When the aerosol-generating article is received within the device cavity, the ventilation zone of the article is arranged to be aligned with and circumscribed by the ventilation chamber defined within the device. This ensures, during normal use of the aerosol-generating system, that the ventilation zone of the aerosol-generating article is covered by the housing of the aerosol-generating device such that the ventilation zone is not exposed to the exterior of the device. It is also ensured that air or aerosol can flow between the ventilation chamber of the device and ventilation zone of the article. This means that the ventilation zone can serve its function of providing ventilation to the article without being obscured or blocked by a consumer's mouth or fingers during normal use.

The ventilation chamber may be adjacent to the mouth end of the aerosol-generating device. The ventilation chamber may extend from the mouth end of the aerosol-generating device. In such embodiments, the ventilation chamber may be in direct fluid communication with the exterior of the aerosol-generating device. The term "direct fluid communication" refers to the fact that no other element or air-flow path is required for fluid (air) to communicate with the ventilation chamber. For example, the ventilation chamber being in a direct fluid communication with the exterior of the aerosol-generating device means that air from the exterior of the aerosol-generating device enters the ventilation chamber directly. In other words, if air would be exiting the ventilation chamber, such air would arrive directly at the exterior of the aerosol-generating device. Preferably, the ventilation chamber is configured to be in fluid communication with the exterior of the aerosol-generating device via the mouth end of the aerosol-generating device. Preferably, the ventilation chamber is configured to be in fluid communication with the exterior of the aerosol-generating device via the mouth end face of the aerosol-generating device. In other words, air is preferably configured to enter the ventilation chamber via the mouth end, or mouth end face, of the aerosol-generating device.

Positioning the ventilation chamber adjacent to the mouth end ensures that air can flow into the ventilation chamber in order to provide fluid communication with the aerosol-generating article and its ventilation zone, if the article comprises a ventilation zone. The ventilation chamber may comprise two ends, a first end and a second end. The second end of the ventilation chamber may be located closer to the mouth end of the aerosol-generating device than the first end of the ventilation chamber. The second end, or proximal end of the ventilation chamber, may be located at the mouth end of the aerosol-generating device. In such embodiments, the second end of the ventilation chamber may be open and the first end of the ventilation may be closed. The second end of the ventilation chamber being open allows air to easily enter the ventilation chamber while also ensuring that a ventilation zone of the aerosol-generating article is concealed from a user during normal use.

In embodiments where the second end of the ventilation chamber is not located at the mouth end of the aerosol-generating device, the second end of the ventilation chamber may be located at least about 1 mm from the mouth end (face) of the aerosol-generating device (or the open end of the device cavity). The second end of the ventilation chamber may be located at least about 2 mm from the mouth end (face) of the aerosol-generating device. The second end of the ventilation chamber may be located at least about 3 mm from the mouth end (face) of the aerosol-generating device.

The first end of the ventilation chamber may be located at least about 10 mm from the distal end of the device cavity. The first end of the ventilation chamber may be located at least about 20 mm from the distal end of the device cavity. The first end of the ventilation chamber may be located at least about 30 mm from the distal end of the device cavity.

The term "mouth end" refers to the portion of an element or component that is configured to be in, or in the vicinity of, the mouth of a user during normal use of the element or component. The mouth end may also correspond to the downstream end. For example, the mouth end of the aerosol-generating article may also be the downstream end of the article. The mouth end of the aerosol-generating article or device is configured to be placed in, or in the vicinity of, the mouth of a consumer during normal use. The mouth end of the aerosol-generating device may also be referred to as the proximal end of the aerosol-generating device. The mouth end of the aerosol-generating device may refer to the mouth end face of the aerosol-generating device that is configured to receive the aerosol-generating article. The open end of the device cavity may therefore be defined at the mouth end face of the aerosol-generating device.

In some embodiments, the ventilation chamber may be located at a longitudinal position away from the mouth end of the aerosol-generating device.

The expression "a longitudinal position away from the mouth end of the aerosol-generating device", in the present context, refers to longitudinal positions which are not located at the mouth end of the aerosol-generating device. Thus, a longitudinal position away from the mouth end of the aerosol-generating device refers to a longitudinal position that is different to (or at a distance from) the longitudinal position of the mouth end of the aerosol-generating device.

By providing the ventilation chamber away from the mouth end of the aerosol-generating device, the ventilation chamber may form a cavity or space around an aerosol-generating article that is received within the cavity of the device and away from the mouth end of the device. When the aerosol-generating article is received with the article, such ventilation chamber is in fluid communication with the exterior of the aerosol-generating article. The exterior of the aerosol-generating article may be defined by a wrapper. The wrapper may be porous. The wrapper may be porous enough to allow air from the ventilation chamber to enter the aerosol-generating article. By allowing air to enter, the ventilation chamber may promote cooling of the article, which may enhance nucleation of aerosol particles within the article. The ventilation chamber may be more likely to promote nucleation when located at a longitudinal position away from the mouth end because the ventilation chamber is more likely to be overlapping a more upstream portion of the aerosol-generating article, closer to where aerosol generation occurs. Accordingly, such a positioning of the ventilation chamber can improve aerosol delivery to a consumer.

In such embodiments, the ventilation chamber has two ends, a first end and a second end. The second end of the ventilation chamber is closer to the mouth end of the device than the first end of the ventilation chamber. In such embodiments, both ends of the ventilation chamber are located away from the mouth end of the aerosol-generating device. In other words, the second end is not located at the mouth end of the device.

In such embodiments, air may flow from the exterior of the device to the ventilation chamber through a gap or space provided between the peripheral wall and the aerosol-generating article, when received within the device cavity, and extending between the ventilation chamber and the mouth end of the device.

In embodiments where the ventilation chamber is located at a longitudinal position away from the mouth end of the aerosol-generating device, the ventilation chamber may be configured to be in fluid communication with the exterior of the aerosol-generating device through a chamber inlet defined in the housing.

The chamber inlet may be a separate element to the device cavity. In other words, the chamber inlet may not be defined by the device cavity and may, instead, be defined in the housing. The chamber inlet may be defined within the peripheral wall, which defines the device cavity. Preferably, the chamber inlet is defined within the thickness of the peripheral wall or on the peripheral wall. In other words, the chamber inlet may be defined on a surface (for example, the interior or inner surface) of the peripheral wall or within the thickness of the peripheral wall, at a position between the inner and outer longitudinal surfaces of the peripheral wall.

The chamber inlet enables fluid communication between the exterior of the aerosol-generating device and the ventilation chamber. Thereby, air from the exterior of the device may be in fluid communication with the wrapper of the aerosol-generating article when received within the device. Such fluid communication enhances the generation of aerosol by promoting nucleation and the cooling of the aerosol generated in the article.

When the aerosol-generating article has a ventilation zone on the wrapper, the air coming from the exterior of the aerosol-generating device through the chamber inlet to the ventilation chamber can pass through the ventilation zone of the article. This provides ventilation for the aerosol-generating article.

Further, in embodiments where the ventilation chamber is located at a longitudinal position away from the mouth end of the aerosol-generating device, generated aerosol may build up within the ventilation chamber. Such build-up of aerosol may enhance a consumer's experience by providing a supplementary source of aerosol. A consumer may draw on such supplementary source of aerosol.

In some embodiments, the chamber inlet may extend between the ventilation chamber and the mouth end of the aerosol-generating device. This enables air to flow from the outside of the device to the ventilation chamber through chamber inlet.

The chamber inlet may extend along any direction from the ventilation chamber in order to establish a fluid connection between the ventilation chamber and the exterior of the device. The chamber inlet may extend substantially along a direction that is parallel to the longitudinal axis of the aerosol-generating device. The chamber inlet may extend substantially along a direction that is perpendicular to the longitudinal axis of the aerosol-generating device.

The chamber inlet may have circular cross-section. The chamber inlet may have an annular cross-section. The chamber inlet may have a cross-section in the shape of an annular sector. An "annular sector" refers to a portion or section of an annular shape or ring.

The chamber inlet and the ventilation chamber may have the same cross-sectional shape. For example, the ventilation chamber may be annular-shaped and the chamber inlet may be annular-shaped. For example, the ventilation chamber may be circular and the chamber inlet may also be circular. Alternatively, the chamber inlet and the ventilation chamber may have different cross-sectional shapes. For example, the chamber inlet may be circular and the ventilation chamber may be annular.

The chamber inlet may have a cross-sectional area that is smaller than the cross-sectional area of the ventilation chamber. The cross-sectional area of the chamber inlet may vary along the longitudinal direction.

The chamber inlet may be cylindrically or conically shaped.

The chamber inlet may have a cross-sectional area that is less than or equal to about 75 percent of a cross-sectional area of the ventilation chamber. The chamber inlet may have a cross-sectional area that is less than or equal to about 50 percent of a cross-sectional area of the ventilation chamber. The chamber inlet may have a cross-sectional area that is less than or equal to about 25 percent of a cross-sectional area of the ventilation chamber. The chamber inlet may have a cross-sectional area that is less than or equal to about 20 percent of a cross-sectional area of the ventilation chamber. The chamber inlet may have a cross-sectional area that is less than or equal to about 10 percent of a cross-sectional area of the ventilation chamber. The chamber inlet may have a cross-sectional area that is less than or equal to about 5 percent of a cross-sectional area of the ventilation chamber.

A diameter of the chamber inlet may be equal to or greater than about 0.1 mm. A diameter of the chamber inlet may be equal to or greater than about 0.2 mm. A diameter of the chamber inlet may be equal to or greater than about 0.5 mm.

A diameter of the chamber inlet may be equal to or less than about 2 mm. A diameter of the chamber inlet may be equal to or less than about 1.5 mm. A diameter of the chamber inlet may be equal to or less than about 1 mm.

A diameter of the chamber inlet may be between about 0.1 mm and about 2 mm. A diameter of the chamber inlet may be between about 0.2 mm and about 1.5 mm. A diameter of the chamber inlet may be between about 0.5 mm and about 1 mm.

The ratio of a diameter of the chamber inlet to a depth of the ventilation chamber may be equal to or less than about 30. The ratio of a diameter of the chamber inlet to a depth of the ventilation chamber may be equal to or less than about 20. The ratio of a diameter of the chamber inlet to a depth of the ventilation chamber may be equal to or less than about 15.

The ratio of a diameter of the chamber inlet to a depth of the ventilation chamber may be equal to or greater than about 2. The ratio of a diameter of the chamber inlet to a depth of the ventilation chamber may be equal to or greater than about 5. The ratio of a diameter of the chamber inlet to a depth of the ventilation chamber may be equal to or greater than about 10.

The range of ratios of a diameter of the chamber inlet to a depth of the ventilation chamber may be between about 2 and about 30. The range of ratios of a diameter of the chamber inlet to a depth of the ventilation chamber may be between about 5 and about 20. The range of ratios of a diameter of the chamber inlet to a depth of the ventilation chamber may be between about 10 and about 15.

Where the depth of the ventilation chamber varies, the depth of the ventilation chamber may refer to the average depth of the ventilation chamber. Where the diameter of the chamber inlet varies, the diameter of the chamber inlet may refer to the average diameter of the chamber inlet.

A length of the chamber inlet may be equal to or greater than about 1 mm. A length of the chamber inlet may be equal to or greater than about 2 mm. A length of the chamber inlet may be equal to or greater than about 3 mm.

A length of the chamber inlet may be equal to or less than about 15 mm. A length of the chamber inlet may be equal to or less than about 10 mm. A length of the chamber inlet may be equal to or less than about 6 mm. A length of the chamber inlet may be equal to or less than about 4 mm.

A length of the chamber inlet may be between about 1 mm and about 15 mm. A length of the chamber inlet may be between about 1 mm and about 6 mm. A length of the chamber inlet may be between about 2 mm and about 6 mm. A length of the chamber inlet may be between about 3 mm and about 4 mm.

The length of the chamber inlet may define a distance of the ventilation chamber from the mouth end of the aerosol-generating device.

There may be plurality of chamber inlets. In such embodiments, the chamber inlets may be evenly and radially distributed at the mouth end of the device.

In some embodiments, the thickness of the portion of the peripheral wall defining the ventilation chamber may be different than a thickness of a different portion of the peripheral wall.

In some embodiments, the thickness of the portion of the peripheral wall defining the ventilation chamber may be less than a thickness of a different portion of the peripheral wall.

In some embodiments, the thickness of the portion of the peripheral wall defining the ventilation chamber may be less than the thickness of the rest of the peripheral wall.

In some embodiments, the thickness of the portion of the peripheral wall defining the ventilation chamber may vary along a longitudinal direction. In such embodiments, the portion of the peripheral wall defining the ventilation chamber may decrease towards the mouth end of the aerosol-generating device. In such embodiments, the portion of the peripheral wall defining the ventilation chamber may increase towards the mouth end of the aerosol-generating device.

A change in thickness of the peripheral wall enables the definition of the ventilation chamber within the peripheral wall of the device cavity. Such change or difference in thickness provides a space between an aerosol-generating article received within the device and the peripheral wall of the device cavity, which in turn enables air to flow between the peripheral wall and the received article. This allows air flow to reach the ventilation zone or wrapper of the article in order to provide a ventilating or cooling effect to the aerosol.

The ventilation chamber may be annular. The ventilation chamber may be a continuous annular chamber defined in the peripheral wall of the device housing. This enables the ventilation chamber to circumscribe the whole wrapper or ventilation zone of a received article, thereby maximising the amount of the overlap between the ventilation chamber and the ventilation zone of a received aerosol-generating article. The greater the amount of overlap, the greater the ventilation that is provided to the aerosol-generating article received in the device. Additionally, an annular ventilation chamber may be simple and efficient to manufacture.

The ventilation chamber may have a longitudinal cross-section that is square shaped, rectangular shaped or triangular shaped.

The ventilation chamber may be an annular portion (or sector) that partially circumscribes the wrapper or ventilation zone of a received aerosol-generating article. The aerosol-generating device may comprise a plurality of ventilation chambers. Such a plurality of ventilation chambers may comprise a plurality of ventilation chambers arranged at different longitudinal positions or a plurality of ventilation chambers arranged at different circumferential positions.

The length of the ventilation chamber may be less than or equal to about 8 mm. The length of the ventilation chamber may be less than or equal to about 4 mm. The length of the ventilation chamber may be less than or equal to about 3 mm.

The length of the ventilation chamber may be greater than or equal to about 1 mm. The length of the ventilation chamber may be greater than or equal to about 2 mm. The length of the ventilation chamber may be greater than or equal to about 1 mm.

The length of the ventilation chamber may be between about 1 mm and about 8 mm. The length of the ventilation chamber may be between about 2 mm and about 4 mm. The length of the ventilation chamber may be between about 3 mm and about 4 mm.

The length of the ventilation chamber may be at least about 2.5 percent of the length of the device cavity. The length of the ventilation chamber may be at least about 5 percent of the length of the device cavity. The length of the ventilation chamber may be at least about 7.5 percent of the length of the device cavity. The length of the ventilation chamber may be at least about 10 percent of the length of the device cavity.

The length of the ventilation chamber may be less than about 40 percent of the length of the device cavity. The length of the ventilation chamber may be less than about 30 percent of the length of the device cavity. The length of the ventilation chamber may be less than about 25 percent of the length of the device cavity. The length of the ventilation chamber may be less than about 20 percent of the length of the device cavity. The length of the ventilation chamber may be less than about 15 percent of the length of the device cavity.

The length of the ventilation chamber may be between about 2.5 percent and about 40 percent of the length of the device cavity. The length of the ventilation chamber may be between about 5 percent and about 30 percent of the length of the device cavity. The length of the ventilation chamber may be between about 7.5 percent and about 25 percent of the length of the device cavity.

By providing a relatively short or small ventilation chamber, a relatively shorter or smaller overlap between the aerosol-generating article and the ventilation chamber of the aerosol-generating device may be achieved. As a result, a more targeted and localised portion of the aerosol-generating article is cooled, when received within the device, and thus the cooling effect resulting from the cooling air entering the ventilation chamber can be more effective on such a portion of the article.

A depth of the ventilation chamber refers to a radial distance by which the ventilation chamber extends into the peripheral wall of the device housing. A depth of the ventilation chamber may be less than or equal to about 3 mm. A depth of the ventilation chamber may be less than or equal to about 2 mm. A depth of the ventilation chamber may be less than or equal to about 1.5 mm.

A depth of the ventilation chamber may be greater than or equal to about 0.5 mm. A depth of the ventilation chamber may be greater than or equal to about 1 mm.

A depth of the ventilation chamber may be between about 0.5 mm and about 3 mm. A depth of the ventilation chamber may be between about 1 mm and about 2 mm.

The transverse cross-sectional area of the ventilation chamber may be greater than or equal to about 5 square mm.

The transverse cross-sectional area of the ventilation chamber may be greater than or equal to about 20 square mm. The transverse cross-sectional area of the ventilation chamber may be greater than or equal to about 50 square mm.

The transverse cross-sectional area of the ventilation chamber may be less than or equal to about 275 square mm. The transverse cross-sectional area of the ventilation chamber may be less than or equal to about 150 square mm.

The transverse cross-sectional area of the ventilation chamber may be between about 5 square mm and about 275 square mm. The transverse cross-sectional area of the ventilation chamber may be between about 20 square mm and about 150 square mm.

A thickness of the peripheral wall of the aerosol-generating device housing defining the device housing may be greater than or equal to about 1 mm. A thickness of the peripheral wall may be greater than or equal to about 2 mm. A thickness of the peripheral wall may be greater than or equal to about 3 mm.

A thickness of the peripheral wall of the aerosol-generating device housing defining the device housing may be less than or equal to about 10 mm. A thickness of the peripheral wall may be less than or equal to about 7.5 mm. A thickness of the peripheral wall may be less than or equal to about 5 mm.

A thickness of the peripheral wall of the aerosol-generating device housing defining the device housing may be between about 1 mm and about 10 mm. A thickness of the peripheral wall may be between about 2 mm and about 7.5 mm. A thickness of the peripheral wall may be between about 3 mm and about 5 mm.

The depth of the ventilation chamber may be less than or equal to about 75 percent of a thickness of the peripheral wall. The depth of the ventilation chamber may be less than or equal to about 50 percent of a thickness of the peripheral wall. The depth of the ventilation chamber may be less than or equal to about 35 percent of a thickness of the peripheral wall.

The depth of the ventilation chamber may be greater than or equal to about 10 percent of a thickness of the peripheral wall. The depth of the ventilation chamber may be greater than or equal to about 20 percent of a thickness of the peripheral wall. The depth of the ventilation chamber may be greater than or equal to about 25 percent of a thickness of the peripheral wall.

The depth of the ventilation chamber may be between about 10 percent and about 75 percent of a thickness of the peripheral wall. The depth of the ventilation chamber may be between about 20 percent and about 50 percent of a thickness of the peripheral wall. The depth of the ventilation chamber may be between about 25 percent and about 35 percent of a thickness of the peripheral wall.

The aerosol-generating device may comprise an extractor for extracting the aerosol-generating article received in the aerosol-generating device, the extractor being configured to be moveable within the device cavity.

The extractor is configured to expose the ventilation chamber when the extractor is in an operating position, the operating position being defined by the heater being in contact with the aerosol-forming substrate of the aerosol-generating article.

The extractor comprises a receptacle body configured to receive an aerosol-generating article. The receptacle body of the extractor (the extractor body) may comprise an end-wall and a peripheral wall. The receptacle body of the extractor comprises an open end, opposite the end-wall, through which an aerosol-generating article can be received. The aerosol-generating article is configured to abut the end-wall once received within the extractor body. The peripheral wall of the receptacle body may circumscribe the aerosol-generating article when received within the extractor. In such embodiments where an extractor is present, the peripheral wall of the extractor body may define the ventilation chamber. Alternatively, the peripheral wall of the device housing may define the ventilation chamber.

The extractor may be sized such that, in the operating position, the receptacle body extends between the first end of the ventilation chamber and the distal end of the device cavity. This enables the aerosol-generating article to be directly exposed to the ventilation chamber without having the extractor body obscuring fluid communication between the ventilation chamber and the aerosol-generating article.

The extractor may be sized such that, in the operating position, the receptacle body extends between the mouth end of the device cavity and the distal end of the device cavity. In such embodiments, the extractor body may have a cut-out, or a plurality of cut-outs, to allow exposure of the ventilation chamber to the aerosol-generating article when inserted. The extractor body and the device cavity together may be configured to ensure alignment during use of said cut-out, or plurality of cut-outs, with the ventilation chamber, or the plurality of ventilation chambers. For example, the extractor body may comprise a projection arranged to cooperate with a slot or groove located in the housing of the aerosol-generating device.

The aerosol-generating device may comprise an elongate heater arranged for insertion into an aerosol-generating article when an aerosol-generating article is received within the device cavity. The elongate heater may be arranged with the device cavity. The elongate heater may extend into the device cavity. Alternative heating arrangements are discussed further below. However, in such embodiments where the heater extends into the device cavity, the extractor body comprises an aperture at an end-wall for allowing the heater to extend into the aerosol-generating article. Such an aperture may allow air to enter the interior of the extractor cavity, so that air may flow through the rod of aerosol-forming substrate of the aerosol-generating article during use. Alternatively, further apertures may be provided in order to allow air to enter the interior of the extractor cavity.

In some embodiments, the length of the extractor body may be less than the length of the device cavity. In such embodiments, when the extractor is in the operating position (when the extractor is abutment with the distal end of the device cavity), the ventilation chamber may be defined by the portion of the peripheral wall of the device housing not circumscribing the extractor. Such a portion of the peripheral wall defines the ventilation chamber when the extractor is in the operating position. Effectively, said portion of the peripheral wall of the device housing may extend longitudinally past the extractor to define the ventilation chamber. The spacing or gap between the aerosol-generating article and the peripheral wall of the device housing defines the ventilation chamber.

An air-flow path may be defined to enable fluid communication between the aerosol-forming substrate of an aerosol-generating article received within the device cavity and the exterior of the aerosol-generating device. This air-flow path allows aerosol formation upon a user puffing on the aerosol-generating article being heated within the aerosol-generating device. Air from the air-flow path may flow into the upstream end of the aerosol-generating article and through the aerosol-forming substrate of the article. Such an air-flow path may be defined within the aerosol-generating device.

In embodiments where there is an extractor provided, an air-flow path may be defined between the peripheral wall of the aerosol-generating device housing and an external surface of the extractor, wherein the ventilation chamber is in fluid communication with said air-flow path.

In embodiments where there is no extractor provided, an air-flow path may be defined within the thickness of the peripheral wall of the aerosol-generating device housing. The air-flow path may also be in fluid communication with the ventilation chamber.

The filter of the aerosol-generating article may comprise a mouthpiece segment comprising a plug of filtration material arranged downstream of the rod of aerosol-forming substrate; and a hollow tubular segment located between the mouthpiece segment and the rod of aerosol-forming substrate, wherein the ventilation zone is located at a position along the upstream half of the hollow tubular segment.

The term "upstream half" refers to the region or portion of an element between the upstream end of the element and the midpoint of the element.

The aerosol-generating article may comprise a ventilation zone at a location along the hollow tubular segment less than about 18 millimetres (mm) from an upstream end of the hollow tubular segment. A distance between the ventilation zone and an upstream end of the hollow tubular segment may be less than about 15 millimetres. Even more preferably, a distance between the ventilation zone and upstream end of the hollow tubular segment is less than about 10 millimetres.

In addition, or as an alternative, a distance between the ventilation zone and an upstream end of the hollow tubular segment may be at least about 2 millimetres. A distance between the ventilation zone and an upstream end of the hollow tubular segment may be at least about 4 millimetres. A distance between the ventilation zone and an upstream end of the hollow tubular segment may be at least about 6 millimetres.

The ventilation zone may be provided at a location along the hollow tubular segment at least about 2 millimetres from the upstream end of the mouthpiece. Preferably, the ventilation zone is provided at a location along the hollow tubular segment at least about 4 millimetres from the upstream end of the mouthpiece. Preferably, the ventilation zone is provided at a location along the hollow tubular segment at least about 5 millimetres from the upstream end of the mouthpiece. Even more preferably, the ventilation zone is provided at a location along the hollow tubular segment at least about 6 millimetres from the upstream end of the mouthpiece.

As the mixture of air and aerosol particles flowing through the aerosol-generating article reaches the ventilation zone, external air drawn into the hollow tubular segment via the ventilation zone is mixed with the aerosol. This rapidly reduces the temperature of the aerosol mixture whilst partially diluting the mixture of air and aerosol particles. By providing the ventilation zone at a distance from the upstream end of the mouthpiece segment falling within the ranges described above, a cooling chamber is effectively provided immediately upstream of the mouthpiece, wherein nucleation and growth of aerosol particles is advantageously favoured. As such, the diluting effect of the ventilation air admitted into the hollow tubular segment is at least partly countered, which advantageously enables the provision of aerosol delivery levels that are satisfactory for the consumer.

The ventilation zone may be provided at a location along the hollow tubular segment at least about 10 millimetres from a downstream end of the mouthpiece segment. The ventilation zone may be provided at a location along the hollow tubular segment at least about 12 millimetres from a downstream end of the mouthpiece segment. The ventilation zone may be provided at a location along the hollow tubular segment at least about 15 millimetres from a downstream end of the mouthpiece segment. This is advantageous in that is ensures that, during use, the ventilation zone is not occluded by the consumer's lips.

In some embodiments, the ventilation zone is provided at a location along the hollow tubular segment from about 10 millimetres to about 25 millimetres from a downstream end of the mouthpiece segment, more preferably from about 12 millimetres to about 20 millimetres from a downstream end of the mouthpiece segment. In an exemplary embodiment, the ventilation zone is provided at a location along the hollow tubular segment about 18 millimetres from the downstream end of the mouthpiece segment. In another exemplary embodiment, the ventilation zone is provided at a location along the hollow tubular segment about 13 millimetres from the downstream end of the mouthpiece segment.

Without wishing to be bound by theory, it has been found that the temperature drop caused by the admission of cooler, external air into the hollow tubular segment via the ventilation zone may have an advantageous effect on the nucleation and growth of aerosol particles.

In this scenario, which may be further complicated by coalescence phenomena, the temperature and rate of cooling can play a critical role in determining how the system responds. In general, different cooling rates may lead to significantly different temporal behaviours as concerns the formation of the liquid phase (droplets), because the nucleation process is typically nonlinear. Without wishing to be bound by theory, it is hypothesised that cooling can cause a rapid increase in the number concentration of droplets, which is followed by a strong, short-lived increase in this growth (nucleation burst). This nucleation burst would appear to be more significant at lower temperatures. Further, it would appear that higher cooling rates may favour an earlier onset of nucleation. By contrast, a reduction of the cooling rate would appear to have a favourable effect on the final size that the aerosol droplets ultimately reach.

Therefore, the rapid cooling induced by the admission of external air into the hollow tubular segment via the ventilation zone can be favourably used to favour nucleation and growth of aerosol droplets. However, at the same time, the admission of external air into the hollow tubular segment has the immediate drawback of diluting the aerosol stream delivered to the consumer.

In addition, it has been found that in aerosol-generating articles in accordance with the invention the cooling and diluting effect caused by the admission of ventilation air at the location along the conduit defined by the hollow tubular segment described above has a surprising reducing effect on the generation and delivery of phenol-containing species.

The ventilation zone may comprise one or more rows of apertures, or perforations, extending through the wrapper of the aerosol-generating article. The apertures, or perforations, of the ventilation zone may extend through the filter of the aerosol-generating article.

The ventilation zone may be located at a position along the rod of aerosol-forming substrate. The ventilation zone may be located at a position downstream of the rod of aerosol-forming substrate. The ventilation zone may be located at a position along the hollow tubular segment. The ventilation zone may be located at a position along the support segment. The ventilation zone may be located at a position along the mouthpiece segment. The apertures of the ventilation zone may extend through the hollow tubular segment, the support segment or the mouthpiece segment, depending on where the ventilation zone is located.

The ventilation zone may be located along the hollow tubular segment and the apertures, or perforations, of the ventilation zone may extend through the peripheral wall of the hollow tubular segment. This is understood to be advantageous in that, by concentrating the cooling effect brought about by ventilation over a short portion of the cavity defined by the hollow tubular segment, it may be possible to further enhance aerosol nucleation. This is because a faster and more drastic cooling of the stream of volatilised species from the aerosol-forming substrate is expected to particularly favour the formation of new nuclei of aerosol particles.

The ventilation zone may comprise only one row of apertures or perforations. A row of apertures, or perforations, may comprise between 8 to 30 apertures or perforations. The ventilation zone may circumscribe the aerosol-generating article. The ventilation zone may circumscribe the rod of aerosol-forming substrate. The ventilation zone may circumscribe the hollow tubular segment. The ventilation zone may circumscribe the support segment. The ventilation zone may circumscribe the mouthpiece segment.

The ventilation perforations may be of uniform size. As an alternative, the ventilation perforations may vary in size. By varying the number and size of the ventilation perforations, it is possible to adjust the amount of external air admitted into the hollow tubular segment when the consumer draws on the mouthpiece of the aerosol-generating article during use. As such, it is advantageously possible to adjust the ventilation level of the aerosol-generating article.

The ventilation perforations can be formed using any suitable technique, for example by laser technology, mechanical perforation of the hollow tubular segment as part of the aerosol-generating article or pre-perforation of the hollow tubular segment before it is combined with the other elements to form the aerosol-generating article. Preferably, the ventilation perforations are formed by online laser perforation.

In aerosol-generating articles in accordance with the present invention the overall resistance-to-draw (RTD) of the article depends essentially on the RTD of the rod of aerosol-forming substrate and on the RTD of the mouthpiece segment of the filter, as a hollow tubular segment is substantially empty and, as such, substantially only marginally contributes to the overall RTD. In practice, the hollow tubular segment may be adapted to generate a RTD in the range of approximately 0 millimetre H2O (about 0 Pa) to approximately 20 millimetres H2O (about 200 Pa). The hollow tubular segment may be adapted to generate a RTD between approximately 0 millimetres H2O (about 0 Pa) to approximately 10 millimetres H2O (about 100 Pa).

The aerosol-generating article may have an overall RTD of less than about 90 millimetres H2O (about 900 Pa). The aerosol-generating article may have an overall RTD of less than about 80 millimetres H2O (about 800 Pa). The aerosol-generating article may have an overall RTD of less than about 70 millimetres H2O (about 700 Pa).

In addition, or as an alternative, the aerosol-generating article may have an overall RTD of at least about 30 millimetres H2O (about 300 Pa). The aerosol-generating article may have an overall RTD of at least about 40 millimetres H2O (about 400 Pa). The aerosol-generating article may have an overall RTD of at least about 50 millimetres H2O (about 500 Pa).

The RTD of the aerosol-generating article may be assessed as the negative pressure that has to be applied, under test conditions as defined in ISO 3402, to downstream end of the mouthpiece in order to sustain a steady volumetric flow of air of 17.5 ml/s through the mouthpiece. The values of RTD listed above are intended to be measured on the aerosol-generating article on its own (that is, prior to inserting the article into an aerosol-generating device) without blocking the perforations of the ventilation zone.

A distance between the ventilation zone and an upstream end of the aerosol-generating article may be less than about 50 millimetres. A distance between the ventilation zone and an upstream end of the aerosol-generating article may be less than about 45 millimetres. A distance between the ventilation zone and an upstream end of the aerosol-generating article may be less than about 40 millimetres.

A distance between the ventilation zone and an upstream end of the aerosol-generating article may be at least about 12 millimetres. A distance between the ventilation zone and an upstream end of the aerosol-generating article may be at least about 15 millimetres. A distance between the ventilation zone and an upstream end of the aerosol-generating article may be at least about 20 millimetres. In some embodiments, a distance between the ventilation zone and an upstream end of the aerosol-generating article may be at least about 25 millimetres.

A distance between the ventilation zone and a downstream end of the rod of aerosol-forming substrate may be at least about 2 millimetres. A distance between the ventilation zone and a downstream end of the rod of aerosol-forming substrate may be at least about 5 millimetres. A distance between the ventilation zone and a downstream end of the rod of aerosol-forming substrate may be at least about 10 millimetres. In some embodiments, a distance between the ventilation zone and a downstream end of the rod of aerosol-forming substrate may be at least about 15 millimetres.

A distance between the ventilation zone and a downstream end of the rod of aerosol-forming substrate may be less than about 35 millimetres. A distance between the ventilation zone and a downstream end of the rod of aerosol-forming substrate may be less than about 30 millimetres. A distance between the ventilation zone and a downstream end of the rod of aerosol-forming substrate may be less than about 25 millimetres.

The rod of aerosol generating substrate preferably has an external diameter that is approximately equal to the external diameter of the aerosol generating article.

Preferably, the rod of aerosol generating substrate has an external diameter of at least about 5 millimetres. The rod of aerosol generating substrate may have an external diameter of between about 5 millimetres and about 12 millimetres, for example of between about 5 millimetres and about 10 millimetres or of between about 6 millimetres and about 8 millimetres. In a preferred embodiment, the rod of aerosol generating substrate has an external diameter of 7.2 millimetres, to within 10 percent.

The rod of aerosol generating substrate may have a length of between about 5 millimetres and about 100 mm. Preferably, the rod of aerosol generating substrate has a length of at least about 5 millimetres, more preferably at least about 7 millimetres. In addition, or as an alternative, the rod of aerosol generating substrate preferably has a length of less than about 80 millimetres, more preferably less than about 65 millimetres, even more preferably less than about 50 millimetres. In particularly preferred embodiments, the rod of aerosol generating substrate has a length of less than about 35 millimetres, more preferably less than 25 millimetres, even more preferably less than about 20 millimetres. In one embodiment, the rod of aerosol generating substrate may have a length of about 10 millimetres. In a preferred embodiment, the rod of aerosol generating substrate has a length of about 12 millimetres.

Preferably, the rod of aerosol generating substrate has a substantially uniform cross-section along the length of the rod. Particularly preferably, the rod of aerosol generating substrate has a substantially circular cross-section.

In preferred embodiments, the aerosol-forming substrate comprises one or more gathered sheets of homogenised tobacco material. Preferably the one or more sheets of homogenised tobacco material are textured. As used herein, the term 'textured sheet' denotes a sheet that has been crimped, embossed, debossed, perforated or otherwise deformed. Textured sheets of homogenised tobacco material for use in the invention may comprise a plurality of spaced-apart indentations, protrusions, perforations or a combination thereof. According to a particularly preferred embodiment of the invention, the rod of aerosol-forming substrate comprises a gathered crimped sheet of homogenised tobacco material circumscribed by a wrapper.

As used herein, the term 'crimped sheet' is intended to be synonymous with the term 'creped sheet' and denotes a sheet having a plurality of substantially parallel ridges or corrugations. Preferably, the crimped sheet of homogenised tobacco material has a plurality of ridges or corrugations substantially parallel to the cylindrical axis of the rod according to the invention. This advantageously facilitates gathering of the crimped sheet of homogenised tobacco material to form the rod. However, it will be appreciated that crimped sheets of homogenised tobacco material for use in the invention may alternatively or in addition have a plurality of substantially parallel ridges or corrugations disposed at an acute or obtuse angle to the cylindrical axis of the rod. In certain embodiments, sheets of homogenised tobacco material for use in the rod of the article of the invention may be substantially evenly textured over substantially their entire surface. For example, crimped sheets of homogenised tobacco material for use in the manufacture of a rod for use in an aerosol-generating article in accordance with the invention may comprise a plurality of substantially parallel ridges or corrugations that are substantially evenly spaced-apart across the width of the sheet.

Sheets or webs of homogenised tobacco material for use in the invention may have a tobacco content of at least about 40 percent by weight on a dry weight basis, more preferably of at least about 60 percent by weight on a dry weight basis, more preferably or at least about 70 percent by weight on a dry basis and most preferably at least about 90 percent by weight on a dry weight basis.

Sheets or webs of homogenised tobacco material for use in the aerosol-forming substrate may comprise one or more intrinsic binders, that is tobacco endogenous binders, one or more extrinsic binders, that is tobacco exogenous binders, or a combination thereof to help agglomerate the particulate tobacco. Alternatively, or in addition, sheets of homogenised tobacco material for use in the aerosol-forming substrate may comprise other additives including, but not limited to, tobacco and non-tobacco fibres, aerosol-formers, humectants, plasticisers, flavourants, fillers, aqueous and non-aqueous solvents and combinations thereof.

Suitable extrinsic binders for inclusion in sheets or webs of homogenised tobacco material for use in the aerosol-forming substrate are known in the art and include, but are not limited to: gums such as, for example, guar gum, xanthan gum, arabic gum and locust bean gum; cellulosic binders such as, for example, hydroxypropyl cellulose, carboxymethyl cellulose, hydroxyethyl cellulose, methyl cellulose and ethyl cellulose; polysaccharides such as, for example, starches, organic acids, such as alginic acid, conjugate base salts of organic acids, such as sodium-alginate, agar and pectins; and combinations thereof.

Suitable non-tobacco fibres for inclusion in sheets or webs of homogenised tobacco material for use in the aerosol-forming substrate are known in the art and include, but are not limited to: cellulose fibres; soft-wood fibres; hard-wood fibres; jute fibres and combinations thereof. Prior to inclusion in sheets of homogenised tobacco material for use in the aerosol-forming substrate, non-tobacco fibres may be treated by suitable processes known in the art including, but not limited to: mechanical pulping; refining; chemical pulping; bleaching; sulphate pulping; and combinations thereof.

The sheets or webs of homogenised tobacco material may comprise an aerosol former. As used herein, the term "aerosol former" describes any suitable known compound or mixture of compounds that, in use, facilitates formation of an aerosol and that is substantially resistant to thermal degradation at the operating temperature of the aerosol-generating article.

Suitable aerosol-formers are known in the art and include, but are not limited to: polyhydric alcohols, such as propylene glycol, triethylene glycol, 1,3-butanediol and glycerine; esters of polyhydric alcohols, such as glycerol mono-, di- or triacetate; and aliphatic esters of mono-, di- or polycarboxylic acids, such as dimethyl dodecanedioate and dimethyl tetradecanedioate.

Preferred aerosol formers are polyhydric alcohols or mixtures thereof, such as propylene glycol, triethylene glycol, 1,3-butanediol and, most preferred, glycerine.

The sheets or webs of homogenised tobacco material may comprise a single aerosol former. Alternatively, the sheets or webs of homogenised tobacco material may comprise a combination of two or more aerosol formers.

The sheets or webs of homogenised tobacco material have an aerosol former content of greater than about 10 percent on a dry weight basis. Preferably, the sheets or webs of homogenised tobacco material have an aerosol former content of greater than about 12 percent on a dry weight basis. More preferably, the sheets or webs of homogenised tobacco material have an aerosol former content of greater than about 14 percent on a dry weight basis. Even more preferably the sheets or webs of homogenised tobacco material have an aerosol former content of greater than about 16 percent on a dry weight basis.

The sheets of homogenised tobacco material may have an aerosol former content of between approximately 10 percent and approximately 30 percent on a dry weight basis. Preferably, the sheets or webs of homogenised tobacco material have an aerosol former content of less than 25 percent on a dry weight basis.

In a preferred embodiment, the sheets of homogenised tobacco material have an aerosol former content of approximately 20 percent on a dry weight basis.

Sheets or webs of homogenised tobacco for use in the aerosol-generating article of the present invention may be made by methods known in the art, for example the methods disclosed in International patent application WO-A-2012/164009 A2. In a preferred embodiment, sheets of homogenised tobacco material for use in the aerosol-generating article are formed from a slurry comprising particulate tobacco, guar gum, cellulose fibres and glycerine by a casting process.

Alternative arrangements of homogenised tobacco material in a rod for use in an aerosol-generating article will be known to the skilled person and may include a plurality of stacked sheets of homogenised tobacco material, a plurality of elongate tubular elements formed by winding strips of homogenised tobacco material about their longitudinal axes, etc.

As a further alternative, the rod of aerosol-forming substrate may comprise a non-tobacco-based, nicotine-bearing material, such as a sheet of sorbent non-tobacco material loaded with nicotine (for example, in the form of a nicotine salt) and an aerosol-former. Examples of such rods are described in the international application WO-A-2015/052652. In addition, or as an alternative, the rod of aerosol-forming substrate may comprise a non-tobacco plant material, such as an aromatic non-tobacco plant material.

The aerosol-forming substrate is circumscribed by a wrapper. The wrapper may be formed of a porous or non-porous sheet material. The wrapper may be formed of any suitable material or combination of materials. Preferably, the wrapper is a paper wrapper.

The mouthpiece segment comprises a plug of filtration material capable of removing particulate components, gaseous components or a combination. Suitable filtration materials are known in the art and include, but are not limited to: fibrous filtration materials such as, for example, cellulose acetate tow, viscose fibres, polyhydroxyalkanoates (PHA) fibres, polylactic acid (PLA) fibres and paper; adsorbents such as, for example, activated alumina, zeolites, molecular sieves and silica gel; and combinations thereof. In addition, the plug of filtration material may further comprise one or more aerosol-modifying agent. Suitable aerosol-modifying agents are known in the art and include, but are not limited to, flavourants such as, for example, menthol. In some embodiments, the mouthpiece may further comprise a mouth end recess downstream of the plug of filtration material. By way of example, the mouthpiece may comprise a hollow tube arranged in longitudinal alignment with, and immediately downstream of the plug of filtration material, the hollow tube forming a cavity at the mouth end that is open to the outer environment at the downstream end of the mouthpiece and of the aerosol-generating article.

A length of the mouthpiece is preferably at least about 4 millimetres, more preferably at least about 6 millimetres, even more preferably at least about 8 millimetres. In addition, or as an alternative, a length of the mouthpiece is preferably less than 25 millimetres, more preferably less than 20 millimetres, even more preferably less than 15 millimetres. In some preferred embodiments, a length of the mouthpiece is from about 4 millimetres to about 25 millimetres, more preferably from about 6 millimetres to about 20 millimetres. The length of the mouthpiece may be about 7 millimetres. The length of the mouthpiece may be about 12 millimetres.

A length of the hollow tubular segment is preferably at least about 10 millimetres. More preferably, a length of the hollow tubular segment is at least about 15 millimetres. In addition, or as an alternative, a length of the hollow tubular segment is preferably less than about 30 millimetres. More preferably, a length of the hollow tubular segment is less than about 25 millimetres. Even more preferably, a length of the hollow tubular segment is less than about 20 millimetres. In some preferred embodiments, a length of the hollow tubular segment is from about 10 millimetres to about 30 millimetres, more preferably from about 12 millimetres to about 25 millimetres, even more preferably from about 15 millimetres to about 20 millimetres. By way of example, in a particularly preferred embodiment the length of the hollow tubular segment is about 18 millimetres. In another particularly preferred embodiment the length of the hollow tubular segment is about 13 millimetres.

A thickness of a peripheral wall of the hollow tubular segment is less than about 1.5 millimetres. Preferably, the thickness of the peripheral wall of the hollow tubular segment is less than about 1250 micrometres, more preferably less than about 1000 micrometres, even more preferably less than about 900 micrometres. In particularly preferred embodiments, the thickness of the peripheral wall of the hollow tubular segment is less than about 800 micrometres.

In addition, or as an alternative, the thickness of the peripheral wall of the hollow tubular segment is at least about 100 micrometres. Preferably, the thickness of the peripheral wall of the hollow tubular segment is at least about 200 micrometres.

An overall length of an aerosol-generating article in accordance with the invention is preferably at least about 40 millimetres. In addition, or as an alternative, an overall length of the aerosol-generating article in accordance with the invention is preferably less than about 70 millimetres, more preferably less than about 60 millimetres, even more preferably less than about 50 millimetres. In preferred embodiments, an overall length of the aerosol-generating article is from about 40 millimetres to about 70 millimetres. In an exemplary embodiment, an overall length of the aerosol-generating article is about 45 millimetres.

The support element (or support segment) may have a length of between about 5 millimetres and about 15 millimetres. In a preferred embodiment, the support element has a length of about 8 millimetres.

The heater may comprise an elongate heating element configured to penetrate the rod of aerosol-forming substrate when the aerosol-generating article is received within the aerosol-generating device.

The heater may be any suitable type of heater. The heater may internally heat the aerosol-generating article. Alternatively, the heater may externally heat the aerosol-generating article. Such an external heater may circumscribe the aerosol-generating article when inserted in or received within the aerosol-generating device.

In some embodiments, the heater is arranged to heat the outer surface of the aerosol-forming substrate. In some embodiments, the heater is arranged for insertion into an aerosol-forming substrate when the aerosol-forming substrate is received within the cavity. The heater may be positioned within the cavity. The heater may extend into the cavity. The heater may be an elongate heater. The elongate heater may be blade-shaped. The elongate heater may be pin-shaped. The elongate heater may be cone-shaped. In some embodiments, the aerosol-generating device comprises an elongate heater arranged for insertion into an aerosol-generating article when an aerosol-generating article is received within the cavity.

The heater may comprise at least one heating element. The at least one heating element may be any suitable type of heating element. In some embodiments, the device comprises only one heating element. In some embodiments, the device comprises a plurality of heating elements.

The heater may comprise at least one resistive heating element. Preferably, the heater comprises a plurality of resistive heating elements. Preferably, the resistive heating elements are electrically connected in a parallel arrangement. Advantageously, providing a plurality of resistive heating elements electrically connected in a parallel arrangement may facilitate the delivery of a desired electrical power to the heater while reducing or minimising the voltage required to provide the desired electrical power. Advantageously, reducing or minimising the voltage required to operate the heater may facilitate reducing or minimising the physical size of the power supply.

Suitable materials for forming the at least one resistive heating element include but are not limited to: semiconductors such as doped ceramics, electrically 'conductive' ceramics (such as, for example, molybdenum disilicide), carbon, graphite, metals, metal alloys and composite materials made of a ceramic material and a metallic material. Such composite materials may comprise doped or undoped ceramics. Examples of suitable doped ceramics include doped silicon carbides. Examples of suitable metals include titanium, zirconium, tantalum and metals from the platinum group. Examples of suitable metal alloys include stainless steel, nickel-, cobalt-, chromium-, aluminium-titanium-zirconium-, hafnium-, niobium-, molybdenum-, tantalum-, tungsten-, tin-, gallium-, manganese- and iron-containing alloys, and super-alloys based on nickel, iron, cobalt, stainless steel, Timetal® and iron-manganese-aluminium based alloys.

In some embodiments, the at least one resistive heating element comprises one or more stamped portions of electrically resistive material, such as stainless steel. Alternatively, the at least one resistive heating element may comprise a heating wire or filament, for example a Ni—Cr (Nickel-Chromium), platinum, tungsten or alloy wire.

In some embodiments, the at least one heating element comprises an electrically insulating substrate, wherein the at least one resistive heating element is provided on the electrically insulating substrate.

The electrically insulating substrate may comprise any suitable material. For example, the electrically insulating substrate may comprise one or more of: paper, glass, ceramic, anodized metal, coated metal, and Polyimide. The ceramic may comprise mica, Alumina ($Al_2O_3$) or Zirconia ($ZrO_2$). Preferably, the electrically insulating substrate has a thermal conductivity of less than or equal to about 40 Watts per metre Kelvin, preferably less than or equal to about 20 Watts per metre Kelvin and ideally less than or equal to about 2 Watts per metre Kelvin.

The heater may comprise a heating element comprising a rigid electrically insulating substrate with one or more electrically conductive tracks or wire disposed on its surface. The size and shape of the electrically insulating substrate may allow it to be inserted directly into an aerosol-forming substrate. If the electrically insulating substrate is not sufficiently rigid, the heating element may comprise a further reinforcement means. A current may be passed through the one or more electrically conductive tracks to heat the heating element and the aerosol-forming substrate.

In some embodiments, the heater comprises an inductive heating arrangement. The inductive heating arrangement may comprise an inductor coil and a power supply configured to provide high frequency oscillating current to the inductor coil. As used herein, a high frequency oscillating current means an oscillating current having a frequency of between 500 kHz and 30 MHz. The heater may advantageously comprise a DC/AC inverter for converting a DC current supplied by a DC power supply to the alternating current. The inductor coil may be arranged to generate a high frequency oscillating electromagnetic field on receiving a high frequency oscillating current from the power supply. The inductor coil may be arranged to generate a high frequency oscillating electromagnetic field in the device cavity. In some embodiments, the inductor coil may substantially circumscribe the device cavity. The inductor coil may extend at least partially along the length of the device cavity.

The heater may comprise an inductive heating element. The inductive heating element may be a susceptor element. As used herein, the term 'susceptor element' refers to an element comprising a material that is capable of converting electromagnetic energy into heat. When a susceptor element is located in an alternating electromagnetic field, the susceptor is heated. Heating of the susceptor element may be the result of at least one of hysteresis losses and eddy currents induced in the susceptor, depending on the electrical and magnetic properties of the susceptor material.

A susceptor element may be arranged such that, when the aerosol-generating article is received in the cavity of the aerosol-generating device, the oscillating electromagnetic field generated by the inductor coil induces a current in the susceptor element, causing the susceptor element to heat up. In these embodiments, the aerosol-generating device is preferably capable of generating a fluctuating electromagnetic field having a magnetic field strength (H-field strength) of between 1 and 5 kilo amperes per metre (kA m), preferably between 2 and 3 kA/m, for example about 2.5 kA/m. The electrically-operated aerosol-generating device is preferably capable of generating a fluctuating electromagnetic field having a frequency of between 1 and 30 MHz, for example between 1 and 10 MHz, for example between 5 and 7 MHz.

In some embodiments, a susceptor element is located in the aerosol-generating article. In these embodiments, the susceptor element is preferably located in contact with the aerosol-forming substrate. The susceptor element may be located in the aerosol-forming substrate. In some embodiments, a susceptor element is located in the aerosol-generating device. In these embodiments, the susceptor element may be located in the cavity. The aerosol-generating device may comprise only one susceptor element. The aerosol-generating device may comprise a plurality of susceptor elements.

In some embodiments, the susceptor element is arranged to heat the outer surface of the aerosol-forming substrate. In some embodiments, the susceptor element is arranged for insertion into an aerosol-forming substrate when the aerosol-forming substrate is received within the cavity.

The susceptor element may comprise any suitable material. The susceptor element may be formed from any material that can be inductively heated to a temperature sufficient to release volatile compounds from the aerosol-forming substrate. Suitable materials for the elongate susceptor element include graphite, molybdenum, silicon carbide, stainless steels, niobium, aluminium, nickel, nickel containing compounds, titanium, and composites of metallic materials. Some susceptor elements comprise a metal or carbon. Advantageously the susceptor element may comprise or consist of a ferromagnetic material, for example, ferritic iron, a ferromagnetic alloy, such as ferromagnetic steel or stainless steel, ferromagnetic particles, and ferrite. A suitable susceptor element may be, or comprise, aluminium. The susceptor element preferably comprises more than about 5 percent, preferably more than about 20 percent, more preferably more than about 50 percent or more than about 90 percent of ferromagnetic or paramagnetic materials. Some elongate susceptor elements may be heated to a temperature in excess of about 250 degrees Celsius.

The susceptor element may comprise a non-metallic core with a metal layer disposed on the non-metallic core. For example, the susceptor element may comprise metallic tracks formed on an outer surface of a ceramic core or substrate.

In some embodiments the aerosol-generating system comprises at least one resistive heating element and at least one inductive heating element. In some embodiments the aerosol-generating system comprises a combination of resistive heating elements and inductive heating elements.

The aerosol-generating device comprises a power supply. The power supply may be a DC power supply. In some embodiments, the power supply is a battery. The power supply may be a nickel-metal hydride battery, a nickel cadmium battery, or a lithium based battery, for example a lithium-cobalt, a lithium-iron-phosphate or a lithium-polymer battery. However, in some embodiments the power supply may be another form of charge storage device, such as a capacitor. The power supply may require recharging and may have a capacity that allows for the storage of enough energy for one or more user operations, for example one or more aerosol-generating experiences. For example, the power supply may have sufficient capacity to allow for continuous heating of an aerosol-forming substrate for a period of around six minutes, corresponding to the typical time taken to smoke a conventional cigarette, or for a period that is a multiple of six minutes. In another example, the power supply may have sufficient capacity to allow for a predetermined number of puffs or discrete activations of the heater.

Specific embodiments will now be described with reference to the figures, in which.

Figure 1:
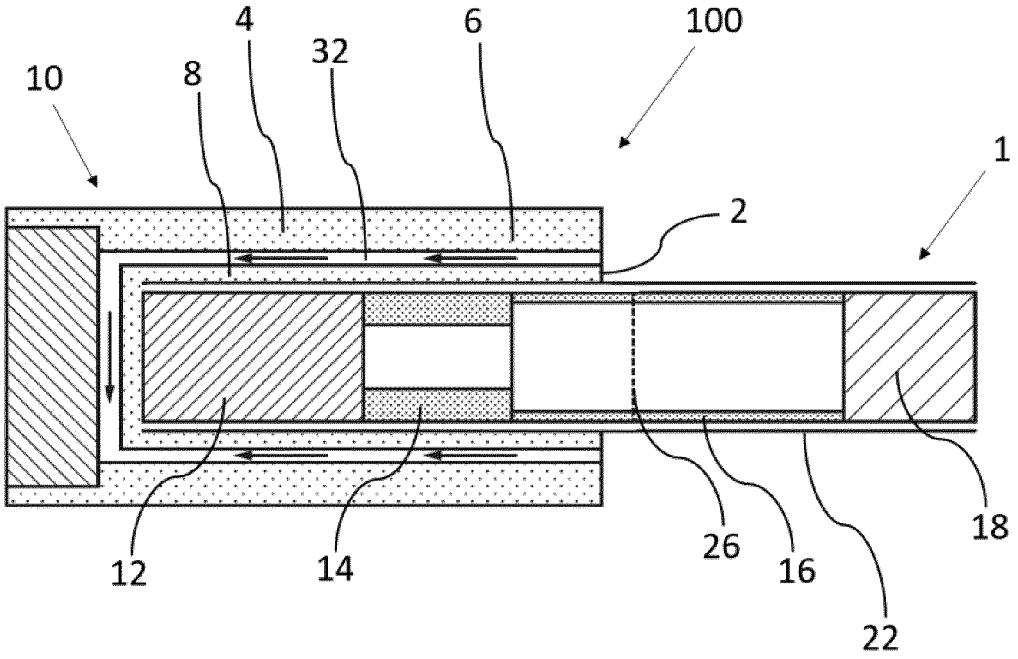
FIG. 1 is a schematic cross-sectional diagram of a comparative aerosol-generating device and a comparative aerosol-generating system.

FIG. 1 illustrates an aerosol-generating system 100 comprising a comparative aerosol-generating device 10 and an aerosol-generating article 1. The aerosol-generating device 10 comprises a housing 4, extending between a mouth end 2 and a distal end (not shown). The housing 4 comprises a peripheral wall 6. The peripheral wall 6 defines a device cavity for receiving an aerosol-generating article 1. An extractor 8 is located within the device cavity defined by the peripheral wall 6 and is configured to receive and extract the aerosol-generating article 1 from the device cavity. The extractor 8 comprises a body having an open, mouth end and a closed end. The closed end of the extractor 8 body is defined by an end-wall. The device cavity is further defined by a closed, distal end and an open, mouth end. The mouth end of the device cavity is located at the mouth end of the aerosol-generating device 10. The aerosol-generating article 1 is configured to be received through the mouth end of the device cavity and is configured to abut either the closed end of the device cavity or a closed end of the extractor 8. The closed end of the extractor 8 is configured to substantially abut, or to be in proximity of, the closed end of the device cavity.

An air-flow path 32 is defined around the external surface of the extractor 8 and between the peripheral wall 6 of the aerosol-generating device housing 4 and an external surface of the extractor 8. Air is allowed to enter the extractor 8 via an aperture (not shown) present at the closed end of the extractor 8 body. This enables air to flow through the rod of aerosol-forming substrate 12 and further downstream through the rest of the aerosol-generating article 1 upon suction being created by user at the mouth end of the article 1.

The aerosol-generating device 10 further comprises a heater (not shown) and a power source (not shown) for supplying power to the heater. A controller (not shown) is also provided to control such supply of power to the heater. The heater is configured to heat the aerosol-generating article 1 during use, when the aerosol-generating article 1 is received within the device 10.

The aerosol-generating article 1 comprises a rod of aerosol-forming substrate 12, a hollow support segment 14, a hollow tubular segment 16 and a mouthpiece segment 18. These four elements are arranged in an end-to-end, longitudinal alignment and are circumscribed by a wrapper 22 to form the aerosol-generating article 1. The aerosol-generating article 1 shown in FIG. 1 is particularly suitable for use with an electrically operated aerosol-generating device 1 comprising a heater for heating the rod of aerosol-forming substrate 12.

The rod of aerosol-forming substrate 12 has a length of about 12 millimetres and a diameter of about 7 millimetres. The rod 12 is cylindrical in shape and has a substantially circular cross-section. The rod 12 comprises a gathered sheet of homogenised tobacco material. The hollow cellulose acetate tube (hollow support segment) 14 has a length of about 8 millimetres and a thickness of 1 millimetre.

The mouthpiece segment 18 comprises a plug of cellulose acetate tow of 8 denier per filament and has a length of about 7 millimetres.

The hollow tubular segment 16 is provided as a cylindrical tube having a length of about 18 millimetres and a thickness of the tube wall is about 100 micrometres.

The aerosol-generating article 1 comprises a ventilation zone 26 provided at least about 5 millimetres from an upstream end of the mouthpiece segment 18. The ventilation zone 26 is at least about 12 millimetres from the downstream end of the aerosol-generating article 1. The ventilation zone 26 is at least about 21 millimetres from a downstream end of the rod 12. The ventilation zone 26 comprises a series or line of perforations extending through the wrapper 22.

As shown in FIG. 1, the ventilation zone 26 of the aerosol-generating article 1 is exposed during use of the system 100.

Figure 2:
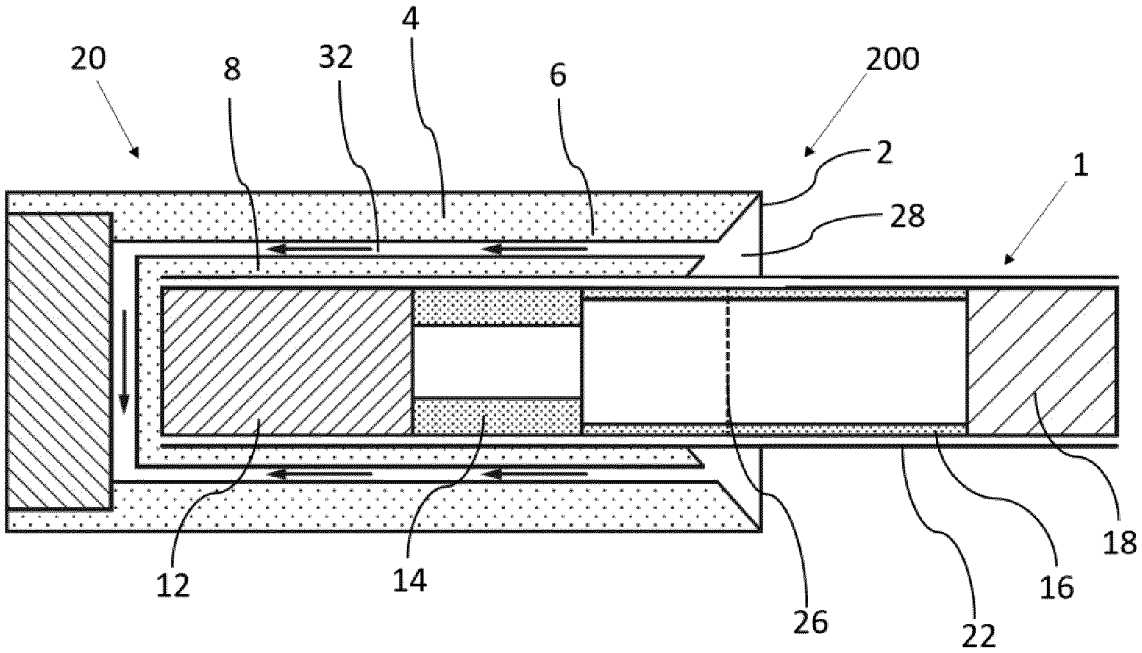
FIG. 2 is a schematic cross-sectional diagram of an embodiment of an aerosol-generating system.

FIG. 2 illustrates an embodiment of an aerosol-generating system 200 comprising an aerosol-generating device 20 and the aerosol-generating article 1. The aerosol-generating device 20 comprises similar features to those described in relation to the aerosol-generating device 10.

The aerosol-generating device 20 further comprises a ventilation chamber 28 configured to circumscribe the ventilation zone 26 of the aerosol-generating article 1 when received within the aerosol-generating device 20. The device cavity has a total length of 30 mm and the ventilation chamber 28 has a length of 6 mm. The ventilation chamber 28 has a longitudinal cross-sectional shape that is triangular. The ventilation chamber 28 is also annular such that the ventilation chamber 28 extends around the entire inner periphery of the peripheral wall 6. During use, the ventilation chamber 28 circumscribes the outer periphery of the aerosol-generating article 1.

The ventilation chamber 28 is in fluid communication with an external surface of the aerosol-generating article 1 and the exterior of the device 10 via the mouth end of the device 10. In particular, the ventilation chamber 28 is configured to be in fluid communication with the ventilation zone 26 of the article 1. The ventilation chamber 28 is also configured to be in fluid communication with the air-flow path 32. The ventilation chamber 28 extends from the mouth end 2 of the device 20 towards the distal end of the device cavity. As shown in FIG. 2, the ventilation chamber 28 is defined within the thickness of the peripheral wall 6.

Figure 3:
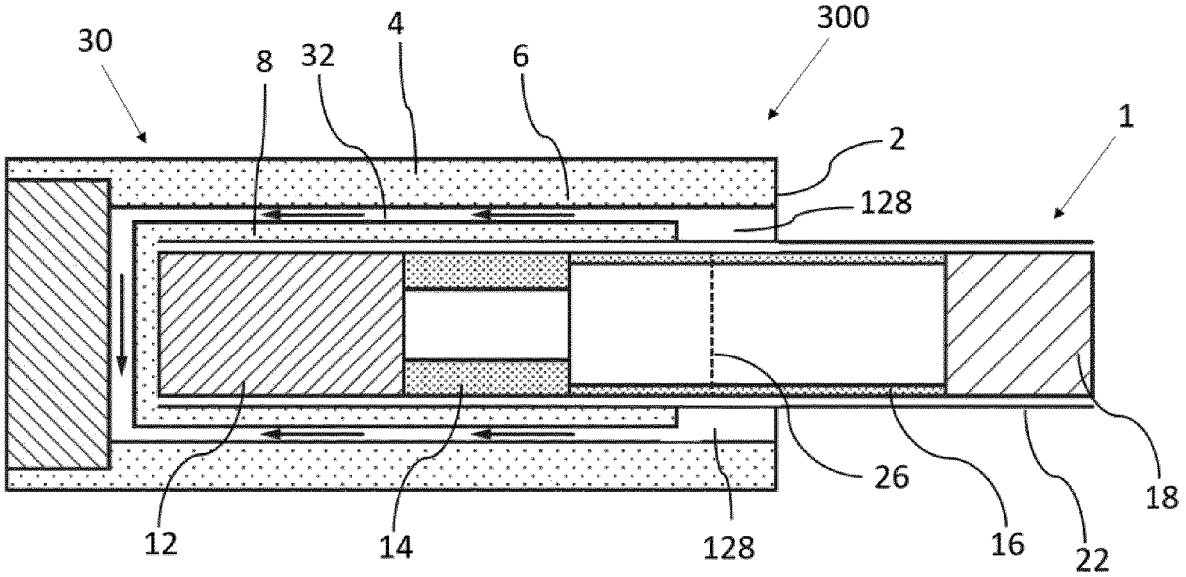
FIG. 3 is a schematic cross-sectional diagram of another embodiment of an aerosol-generating system.

FIG. 3 illustrates another embodiment of an aerosol-generating system 300 comprising an aerosol-generating device 30 and the aerosol-generating article 1. The aerosol-generating device 30 comprises an extractor 8 that is shorter than the length of the device cavity. During use, when an aerosol-generating article 10 is received within the device 30, a space is defined between the proximal end of the extractor 8 and the mouth end 2 of the device 30. Such space defines a ventilation chamber 128 that circumscribes the aerosol-generating article 1, in particular, the ventilation zone 26. The ventilation chamber 128 is configured to be in fluid communication with the ventilation zone 26 of the article 1. The ventilation chamber 28 is also configured to be in fluid communication with the air-flow path 32 defined around the extractor 8. The ventilation chamber 128 has a length of 6 mm.

The ventilation chamber 128 has a longitudinal cross-sectional shape that is rectangular. The ventilation chamber 128 is also annular such that the ventilation chamber 28 extends the entire inner periphery of the peripheral wall 6. In other words, during use, the ventilation chamber 28 circumscribes the outer periphery of the aerosol-generating article 1. The ventilation chamber 128 extends away from the mouth end 2 of the device 30.

In both the embodiments of FIGS. 2 and 3, the ventilation chamber 28, 128 is in direct fluid communication with the exterior of the aerosol-generating device 20, 30.

Figure 4:
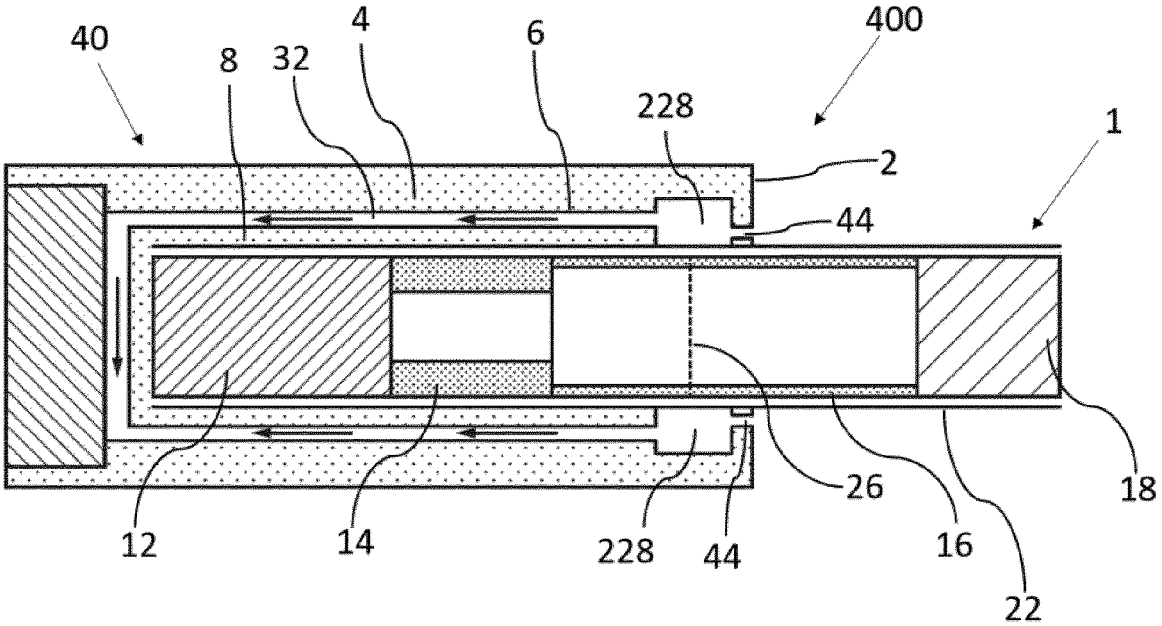
FIG. 4 is a schematic cross-sectional diagram of a further embodiment of an aerosol-generating system.

FIG. 4 illustrates another embodiment of an aerosol-generating system 400 comprising an aerosol-generating device 40 and the aerosol-generating article 1. The aerosol-generating device 40 comprises an extractor 8.

The aerosol-generating device 40 comprises a ventilation chamber 228 configured to circumscribe the ventilation zone 26 of the aerosol-generating article 1 when received within the aerosol-generating device 40. The device cavity has a total length of 30 mm and the ventilation chamber 228 has a length of 6 mm. The ventilation chamber 228 has a longitudinal cross-sectional shape that is rectangular. The ventilation chamber 228 is also annular such that the ventilation chamber 228 extends around the entire inner periphery of the peripheral wall 6. During use, the ventilation chamber 228 circumscribes the outer periphery of the aerosol-generating article 1.

The ventilation chamber 228 is configured to be in fluid communication with the ventilation zone 26 of the article 1 and the exterior of the aerosol-generating device 40. The ventilation chamber 228 is also configured to be in fluid communication with the air-flow path 32 defined around the extractor 8.

As shown in FIG. 4, the ventilation chamber 228 is located away from the mouth end 2 of the aerosol-generating device 40. The ventilation chamber 228 is not in direct fluid communication with the exterior of the aerosol-generating device 40. The ventilation chamber 228 is in fluid communication with the exterior of the aerosol-generating device 40 through a plurality of chamber inlets 44. Each chamber inlet 44 extends between the ventilation chamber 228 and the mouth end 2 of the aerosol-generating device 40 so as to ensure fluid communication between the ventilation chamber 228 and the mouth end 2 of the aerosol-generating device 40.

Each chamber inlet 44 has a circular cross-section. The diameter of each chamber inlet 44 is substantially smaller than the depth (that is, the radial depth) of the ventilation chamber 228. As shown in FIG. 4, the depth of the ventilation chamber 228 is more than five times the diameter of the chamber inlet 44.

During use of the above described aerosol-generating systems 200, 300, 400, when the aerosol-generating article 1 is received within the cavity of the aerosol-generating device 20, 30, 40, the ventilation zone 26 of the aerosol-generating article 1 cannot be directly blocked by a consumer. This is a result of the overlap of the peripheral wall 6 with the ventilation zone 26.

The invention claimed is:

1. An aerosol-generating system, comprising:

an aerosol-generating article comprising:

a rod of aerosol-forming substrate, a filter disposed downstream of the rod of aerosol-forming substrate, wherein the rod of aerosol-forming substrate and the filter are assembled within a wrapper, and a ventilation zone located on the wrapper, the ventilation zone comprising a plurality of apertures extending through the wrapper; and an aerosol-generating device comprising:

a distal end and a mouth end defined by a mouth end face of the aerosol-generating device, a housing comprising a peripheral wall, the peripheral wall defining a device cavity configured to removably receive the aerosol-generating article at the mouth end face of the aerosol-generating device, and a heater configured to heat the aerosol-forming substrate when the aerosol-generating article is received within the device cavity, wherein the aerosol-generating system is configured so that, when the aerosol-generating article is received within the device cavity, the ventilation zone of the aerosol-generating article is located within the device cavity and a portion of an internal surface of the peripheral wall overlying the ventilation zone is spaced apart from the aerosol-generating article to define a ventilation chamber within the peripheral wall, wherein the ventilation chamber is configured to be in fluid communication with an exterior of the aerosol-generating device via the mouth end face of the aerosol-generating device, the mouth end face comprising a terminal end face that defines an open end of the device cavity and is oriented transversely to a longitudinal axis of the aerosol generating device, and with the ventilation zone of the aerosol-generating article, such that air is configured to enter the ventilation chamber through the terminal end face when the aerosol-generating article is received within the device cavity, and wherein a thickness of the portion of the peripheral wall defining the ventilation chamber is different than a thickness of a different portion of the peripheral wall.

2. The aerosol-generating system according to claim 1, wherein the ventilation chamber is defined within a thickness of the peripheral wall.

3. The aerosol-generating system according to claim 1, wherein the ventilation chamber is adjacent to the mouth end of the aerosol-generating device.

4. The aerosol-generating system according to claim 1, wherein the ventilation chamber is located at a longitudinal position away from the mouth end of the aerosol-generating device.

5. The aerosol-generating system according to claim 4, wherein the ventilation chamber is configured to be in fluid communication with the exterior of the aerosol-generating device through a chamber inlet defined in the housing.

6. The aerosol-generating system according to claim 5, wherein the chamber inlet extends between the ventilation chamber and the mouth end of the aerosol-generating device.

7. The aerosol-generating system according to claim 1, wherein a thickness of the portion of the peripheral wall defining the ventilation chamber is less than a thickness of a different portion of the peripheral wall.

8. The aerosol-generating system according to claim 7, wherein the thickness of the portion of the peripheral wall defining the ventilation chamber varies along a longitudinal direction.

9. The aerosol-generating system according to claim 1, wherein the ventilation chamber is annular.

10. The aerosol-generating system according to claim 1, wherein the aerosol-generating device further comprises an extractor configured to extract the aerosol-generating article received in the aerosol-generating device, and to be moveable within the device cavity.

11. The aerosol-generating system according to claim 10, wherein the extractor is further configured to expose the ventilation chamber when the extractor is in an operating position, the operating position being defined by the heater being in contact with the aerosol-forming substrate of the aerosol-generating article.

12. The aerosol-generating system according to claim 10, wherein an air-flow path is defined between the peripheral wall of the aerosol-generating device housing and an external surface of the extractor, and wherein the ventilation chamber is in fluid communication with the air-flow path.

13. The aerosol-generating system according to claim 1, wherein the filter of the aerosol-generating article comprises:

a mouthpiece segment comprising a plug of filtration material arranged downstream of the rod of aerosol-forming substrate, and a hollow tubular segment located between the mouthpiece segment and the rod of aerosol-forming substrate, wherein the ventilation zone is located at a position along the hollow tubular segment.

14. The aerosol-generating system according to claim 1, wherein the heater comprises an elongate heating element configured to penetrate the rod of aerosol-forming substrate when the aerosol-generating article is received within the aerosol-generating device.

15. The aerosol-generating system according to claim 13, wherein the ventilation zone is located at a position along an upstream half of the hollow tubular segment.

16. The aerosol-generating system according to claim 13, wherein the plurality of apertures of the ventilation zone extend through the hollow tubular segment.

* * * * *